United States Patent [19]

Flanagan

[11] 4,228,321

[45] Oct. 14, 1980

[54] PRIVACY TRANSMISSION SYSTEM WITH REMOTE KEY CONTROL

[75] Inventor: James L. Flanagan, Warren, N.J.

[73] Assignee: Bell Telephone Laboratories, Incorporated, Murray Hill, N.J.

[21] Appl. No.: 906,328

[22] Filed: May 16, 1978

[51] Int. Cl.[3] ..... H04K 1/00

[52] U.S. Cl. ..... 179/1.5 S; 179/1.5 R; 375/2

[58] Field of Search ..... 179/1.5 R; 178/22

[56] References Cited

U.S. PATENT DOCUMENTS

| | | | |
|---|---|---|---|
| 2,129,860 | 9/1938 | Mitchell | 179/1.5 R |
| 2,405,500 | 8/1946 | Guanella | 179/1.5 R |
| 2,463,502 | 3/1949 | Atkins | 179/1.5 R |
| 2,556,677 | 6/1951 | Chapman | 179/1.5 R |
| 3,696,207 | 10/1972 | Lundin et al. | 178/22 |
| 3,718,765 | 2/1973 | Halaby | 179/1.5 R |
| 3,924,075 | 12/1975 | Gannett | 178/22 |

OTHER PUBLICATIONS

"New Directions in Cryptography," Diffie et al., IEEE Transactions on Information Theory, vol. IT-22, No. 6, Nov. 1976, pp. 644-654.

*Primary Examiner*—Howard A. Birmiel

*Attorney, Agent, or Firm*—Joseph P. Kearns; Hugh L. Logan

[57] ABSTRACT

In the prior art key control signals are produced at a scrambling location, used at that location for scrambling and then transmitted along with the scrambled message to the unscrambling location. In accordance with the present disclosure, improved privacy is achieved by producing key control signals at the unscrambling location, using them at that location for unscrambling and also transmitting them to the scrambling location for use in scrambling.

5 Claims, 3 Drawing Figures

PRIVACY TRANSMISSION SYSTEM WITH REMOTE KEY CONTROL

BACKGROUND OF THE INVENTION

1. Field of the Invention

This invention relates to privacy transmission systems in which speech or other messages are scrambled prior to transmission and unscrambled upon reception.

2. Description of the Prior Art

The prior art discloses numerous privacy transmission systems in which speech or other messages are scrambled prior to transmission and unscrambled upon reception. The scrambling and unscrambling processes frequently operate on the frequency and/or time parameters of such messages. Whether it is these or other parameters, it is of course essential that the two processes be performed in synchronism so that the original message is recovered. Furthermore, for reliable privacy it is also essential that the scrambling and unscrambling processes limit the use of a particular key (i.e., code or format) so that an unauthorized receiver cannot use known techniques to unscramble a portion of the message.

U.S. Pat. No. 2,405,500 issued to G. Guanella on Aug. 6, 1946 discloses a privacy system conceived to achieve the above-mentioned results. This system uses a control signal to control the scrambling of a message and then transmits the control signal along with the scrambled message. When received, the control signal is used to control the unscrambling process. The control signal in this system may however be extracted at any point along the message transmission path by an unauthorized receiver. When the unauthorized receiver has access to the keys available for scrambling and unscrambling, the extracted control signal can be used to unscramble the message in the same manner as the authorized receiver.

SUMMARY OF THE INVENTION

An object of the present invention is to use a key control signal in a transmission privacy system so that the level of privacy is increased.

This and other objects are achieved by doing the opposite of what is done in the above-described prior art; i.e., in accordance with the present invention, the control signal is generated at the receiving end and transmitted to the transmitting end either over the same path as the message or over a separate path.

In accordance with the invention, a first control signal in a particular frequency band is transmitted from a first station to a second station. Similarly, a second control signal in the same fequency band is transmitted from the second to the first station. The first control signal is used at the second station to control the scrambling of the message to be transmitted and at the first station to unscramble the received scrambled message. Similarly, the second control signal is used at the first station to control the scrambling of the message to be transmitted and at the second station to unscramble the received scrambled message.

When a preferred embodiment of the invention is used in a conventional telephone system, the two control signals appear within the same narrow frequency band on the local loops (i.e., the two-wire circuits between a subscriber's station equipment and the toll plant). Scrambled messages also appear on these loops. Although an unauthorized receiver could use a narrow band filter to extract the control signals, the extracted signals would not be of any use because they cannot be separated from one another.

In the toll plant of such a telephone system, the first control signal and the scrambled message from the first station travel in one path while the second control signal and the scrambled message from the second station travel in a different path. In other words, the control signal required to unscramble a given scrambled message is not in the same path as the scrambled message. Therefore, in the toll plant the difficulty of access to toll facilities and the multiplicity of paths makes it virtually impossible for an unauthorized receiver to locate two related paths.

These and other objects and features of the invention will become more apparent from the following description of several embodiments of the invention.

DETAILED DESCRIPTION

Figure 1:
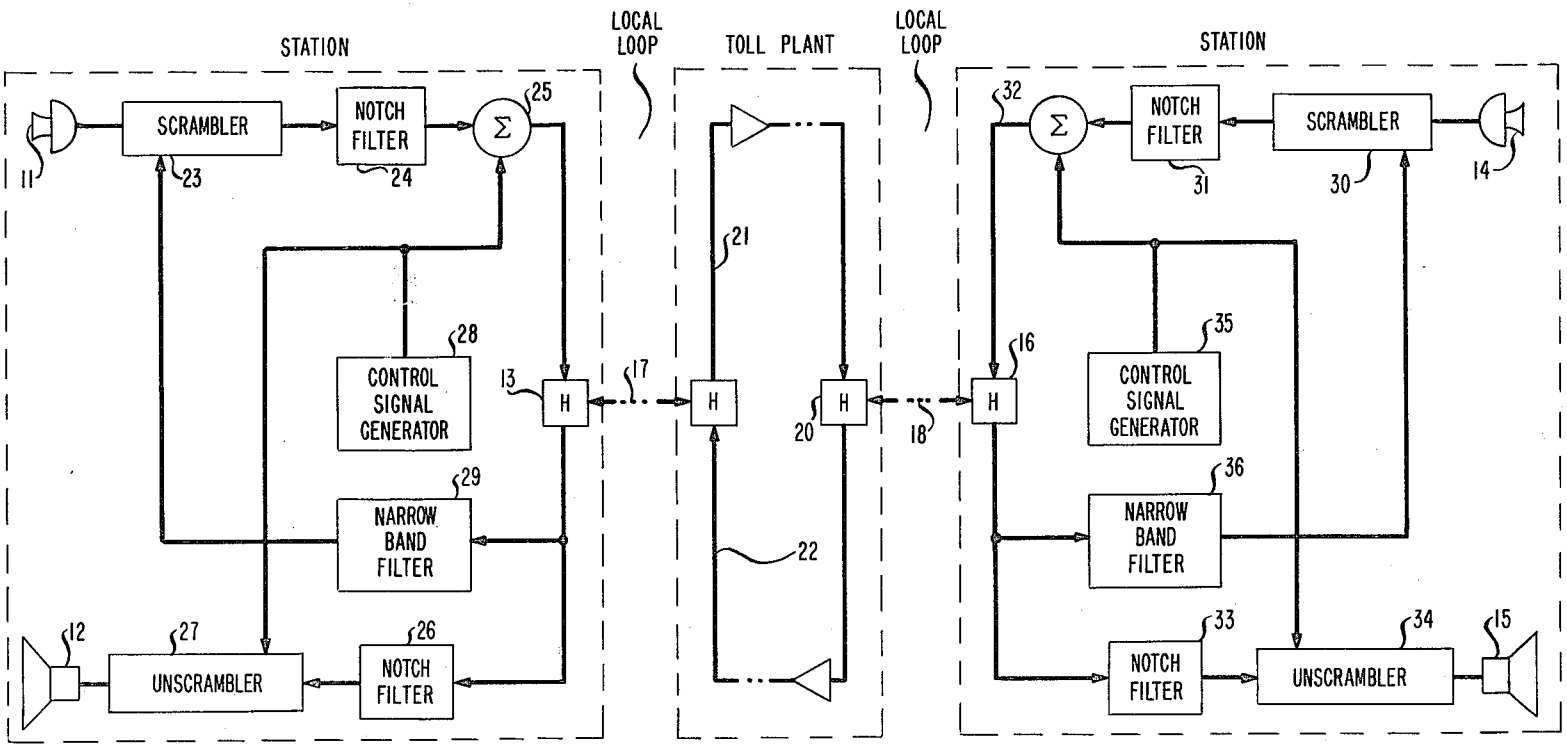
FIG. 1 depicts a block diagram of one embodiment of the invention as it appears in a telephone system.

In FIG. 1, an embodiment of the invention is disclosed in a conventional subscriber-to-subscriber path in a telephone system. The portions which comprise the conventional telephone path include a first station comprising a telephone transmitter 11, a telephone receiver 12 and a hybrid circuit 13; a second station comprising a telephone transmitter 14, a telephone receiver 15 and a hybrid circuit 16; two local loops 17 and 18; and a toll plant comprising hybrid circuits 19 and 20 interconnected by paths 21 and 22. Paths 21 and 22 may comprise conventional wired circuits or microwave links.

Transmitter 11 is connected via a multikey (or multicode) scrambler 23, a notch filter 24 and a summer 25 to hybrid circuit 13. Scrambler 23 scrambles inputs from transmitter 11 in accordance with keys determined by a control signal input to the scrambler. Scrambling may be on a time and/or frequency basis. Notch filter 24, on the other hand, suppresses the scrambled message content in a particular frequency band.

The first station also includes a notch filter 26 similar to filter 24 and a multikey unscrambler 27 connected in series between hybrid circuit 13 and receiver 12. It further includes a control signal generator 28 whose output is variable but within the previously mentioned frequency band. This signal is applied to both summer 25 and unscrambler 27. Finally, a narrow band filter 29 is connected between hybrid circuit 13 and scrambler 23.

In an identical manner the second station includes a multikey scrambler 30, notch filter 31, a summer 32, a notch filter 33, an unscrambler 34, a control signal generator 35 and a narrow band filter 36.

The variable control signal output from generator 28 is transmitted to the second station via summer 25 and is also applied to unscrambler 27. At the second station, this control signal is passed by narrow band filter 36 to scrambler 30 where it controls the selection of keys used by the scrambler. A scrambled message output from scrambler 30 is transmitted to the first station where it is passed by notch filter 26 to unscrambler 27. As the same control signal used to select keys for scrambling the message is applied to unscrambler 27, the original message appears as the output of unscrambler 27.

In an identical manner, the control signal from generator 35 is transmitted to the first station where it is extracted by narrow band filter 29 and applied to scrambler 23. Furthermore, this same control signal is applied to unscrambler 34. A scrambled message output from scrambler 23 is transmitted to the second station where it is passed by notch filter 33 and unscrambled by unscrambler 34 to produce the original message.

Notch filters 24 and 31 function to suppress scrambled message portions within a particular frequency band so that control signals may be transmitted and recovered to the substantial exclusion of the scrambled messages. In particular, narrow band filters 29 and 36 are able to extract the control signals substantially free of any of the scrambled messages. Notch filters 26 and 33, on the other hand, extract the scrambled messages to the substantial exclusion of the control signals.

The outputs from control signal generators 28 and 35 are continuous, are variable to produce key changes and are different from one another. These continuous, variable and different signals appear together on local loops 17 and 18. An unauthorized receiver could extract both of these signals from these loops by way of a narrow band filter. However, such a receiver could not separate the signals from one another. Consequently, even though such a receiver had access to the keys in use, this would be to no avail since the individual control signals would not be available.

In the toll plant, the scrambled message output from scrambler 23 appears on path 21 while the control signal used to produce this scrambling appears on path 22. Similarly, the scrambled message output from scrambler 30 appears on path 22 while the control signal used to produce this scrambling appears on path 21. Because a scrambled message and the control signal used to produce it appear on different paths and, furthermore, because there are many paths in a toll plant, the possibility of an unauthorized receiver finding in the toll plant a related scrambled message and control signal is extremely small. There is, therefore, a very high degree of privacy provided in both the local loops and the toll plant.

Figure 2:
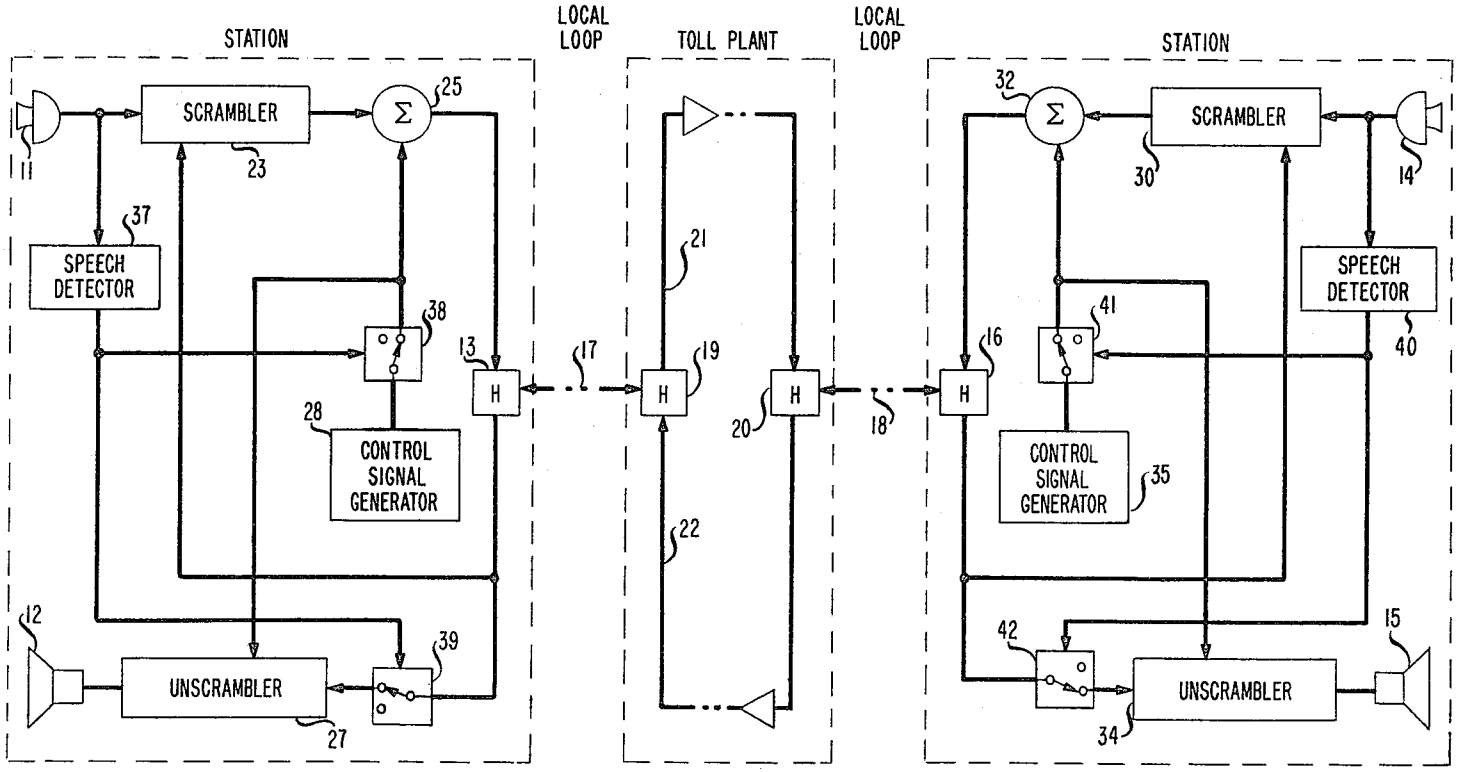
FIG. 2 depicts a block diagram of a second embodiment of the invention as it appears in a telephone system.

Another embodiment of the invention is shown in FIG. 2. Many of the elements in this embodiment are identical to those in the embodiment of FIG. 1 and consequently the same symbols have been used. The differences between the two embodiments are: filters 24, 26, 29, 31, 33 and 36 of FIG. 1 have been replaced with straight-through connections; a speech detector 37 and normally closed relays 38 and 39 have been added to the left-hand station to open the output path of control signal generator 38 and the input path of unscrambler 27 when speech is originating at this station; and a speech detector 40 and normally closed relays 41 and 42 have been similarly added to the right-hand station to open the output path of control signal generator 35 and the input path of scrambler 34 when speech originates at this station. As before, the control signals are within the frequency band of the outputs of scramblers 23 and 30.

The operation of the embodiment of FIG. 2 may be best understood by assuming speech input at one of the stations. Assume, for example, that there is speech input at the left-hand station. In that case, speech detector 37 operates relays 38 and 39 to open the paths in which they are located while relays 41 and 42 in the right-hand station remain closed. A control signal is therefore transmitted from the right-hand station to the left-hand station. This signal cannot enter unscrambler 27 but is applied to scrambler 23. The scrambled output of scrambler 23—but not the output from generator 28—is transmitted to the right-hand station. The scrambled message received by the right-hand station is applied to both unscrambler 34 and scrambler 30. The output of unscrambler 34 is applied to receiver 15. Scrambler 30, on the other hand, fails to produce any output because speech is not originating at the right-hand station. But key control signal from generator 35 passes to summer 32 via relay switch 41 and is transmitted to the left-hand station where it is used as the control input to scrambler 23. When speech originates at the right-hand station, this procedure is reversed.

When messages originate at both stations at the same time, detectors 37 and 38 both produce outputs to operate their respective relays. In this condition neither scrambler receives control signals and this prevents transmission of messages in either direction during simultaneous talking.

As far as privacy is concerned, the embodiment of FIG. 2 provides (for non-simultaneous talking) the same degree of privacy as that of FIG. 1. In particular, scrambled messages traveling in one direction have components in the same frequency band as the control signal traveling in the opposite direction. The control signals, in fact, need not be narrow band signals but may occupy a frequency band which includes that of the scrambled messages.

Figure 3:
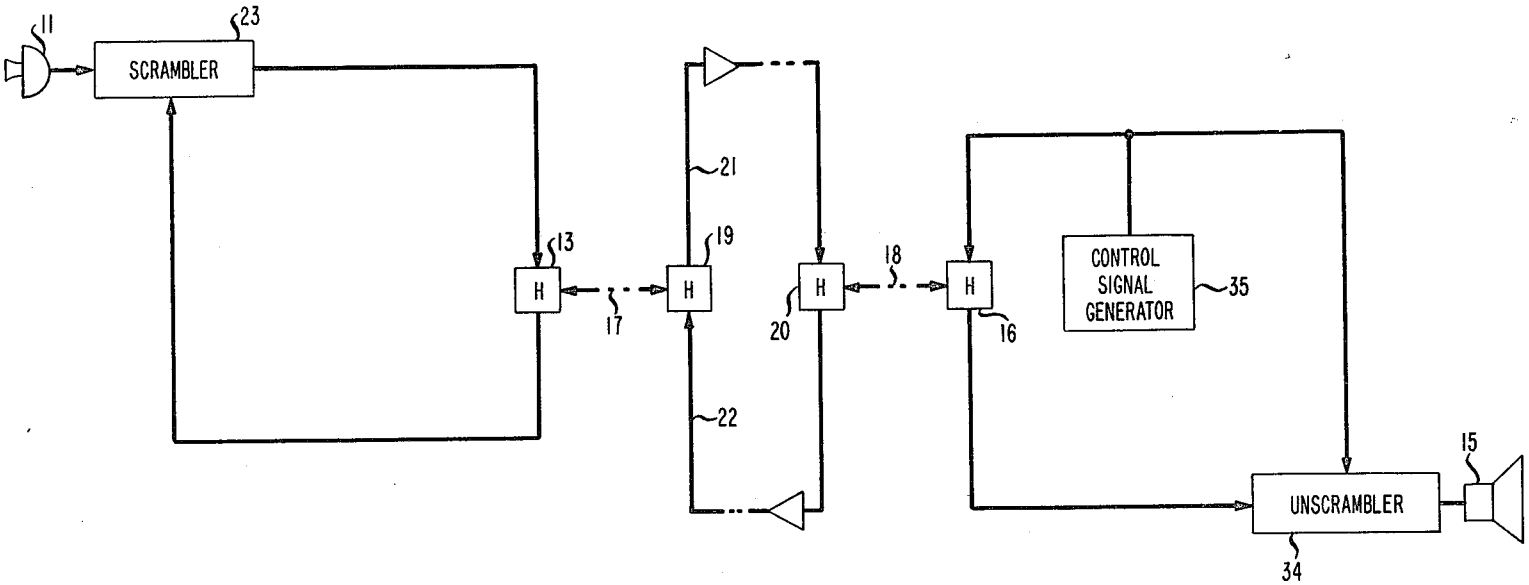
FIG. 3 is a block diagram showing the elements of FIG. 1 necessary for one-way transmission of messages.

When embodiments of the invention are to be used for one-way transmission only, numerous elements may be omitted. For example, for left-to-right transmission, any number or all of the following elements of FIG. 1 may be omitted: receiver 12, unscrambler 27, filters 24, 26 and 29, generator 28 and summer 25 in the left-hand station and transmitter 14, scrambler 30, filters 31, 33 and 36 and summer 32 in the right-hand station. A system with all of the above-identified elements omitted is shown in FIG. 3. This one-way system has, however, all of the privacy available with the disclosed two-way systems.

I claim:

1. In a two-way privacy communication system (FIG. 1) including a transmission link having separate paths (21,22) for opposite transmission directions between first and second stations, said first station having multikey scrambling means (23) and multikey unscrambling means (27) and said second station having multikey scrambling means (30) and multikey unscrambling means (34) CHARACTERIZED IN THAT means (35) for generating a first key control signal is provided at said second station, means also at said second station applies said first control signal to said unscrambling means (34), means (16,18) further at said second station transmits said first control signal over one unidirectional path (22) to said first station, means (28) for generating a second key control signal is provided at said first station, means also at said first station applies said second control signal-to said unscrambling means (27), means (13,17) further at said first station transmits said second control signal over another unidirectional path (21) to said second station, means (29) at said first station applies said first key control signal received from said second station to said scrambling means (23) to control the scrambling of messages to be transmitted by said first station over another unidirectional path (21) to said second station, and means (36) at said second station applies said second key control signal received from said first station to said scrambling means (30) to control the scrambling of messages to be transmitted by said second station over one unidirectional path (22) to said first station.

2. A transmission system in accordance with claim 1 in which said improvement is still further characterized in that means (24,31) are provided in said stations so that said key control signals and the outputs of said scrambling means as transmitted do not occupy the same frequency band and means (26, 29, 33, 36) are provided at the respective stations to apply only received control signals to the scrambling means at each station and to apply received scrambled messages, to the exclusion of received control signals to the unscrambling means at each station.

3. The privacy communication system in accordance with claim 1 further characterized in that said key control signals and the outputs of said scrambling means as transmitted occupy at least some of the same frequency band, and each of said stations includes means (37–42) for preventing the transmission of the control signals produced at that station when messages originate at that station.

4. A method for transmitting messages between first and second stations with enhanced privacy comprising the steps of transmitting from said first station to said second station a first control signal over one transmission path therebetween, transmitting from said second station to said first station a second control signal over another transmission path therebetween, using said second signal at said first station to cause messages which are to be transmitted to be scrambled in a controlled manner to produce scrambled messages having substantially no frequency components derived from said second signal, transmitting said scrambled messages to said second station over said one transmission path, and using said second signal at said second station to unscramble in a controlled manner the scrambled messages received from said first station over said other transmission path.

5. A method for transmitting messages between first and second stations with enhanced privacy comprising the steps of transmitting from said first station to said second station a first control signal over a first transmission path when a message is not being transmitted from said first station to said second station, transmitting from said second station to said first station a second control signal over a second transmission path when a message is not being transmitted from said second station to said first station, using said second control signal at said first station received over said second transmission path and said first control signal at said second station received over said first transmission path to cause messages which are to be transmitted to said second station to be scrambled in a controlled manner, transmitting said scrambled messages between said stations over a transmission path other than one carrying its control signal, and using said second signal at said second station and said first signal at said first station to unscramble in a controlled manner the scrambled messsages received from the other station.

* * * * *